US009371146B2

(12) United States Patent
Tsuruta et al.

(10) Patent No.: US 9,371,146 B2
(45) Date of Patent: Jun. 21, 2016

(54) ASEPTIC FILLING PACKAGING MACHINE AND ASEPTIC FILLING PACKAGING METHOD

(75) Inventors: Orihiro Tsuruta, Gunma (JP); Shunji Yamada, Gunma (JP)

(73) Assignee: ORIHIRO ENGINEERING CO., LTD., Takasaki (JP)

( * ) Notice: Subject to any disclaimer, the term of this patent is extended or adjusted under 35 U.S.C. 154(b) by 727 days.

(21) Appl. No.: 13/263,690

(22) PCT Filed: Apr. 10, 2009

(86) PCT No.: PCT/JP2009/057321

§ 371 (c)(1),
(2), (4) Date: Oct. 7, 2011

(87) PCT Pub. No.: WO2010/116519

PCT Pub. Date: Oct. 14, 2010

(65) Prior Publication Data

US 2012/0017540 A1 Jan. 26, 2012

(51) Int. Cl.

*B65B 55/10* (2006.01)
*B65B 61/18* (2006.01)
*B65B 9/20* (2012.01)

(52) U.S. Cl.

CPC ..... *B65B 55/103* (2013.01); *B65B 61/186* (2013.01); *B65B 9/20* (2013.01)

(58) Field of Classification Search

CPC .... B65B 1/186; B65B 55/022; B65B 55/103; B65B 61/186; B65B 43/44; B65B 55/02; B65B 55/04; B65B 9/20; B29C 65/00; B29C 66/53263; B29C 66/4742; B29C 66/47421; B29C 66/53262

USPC ..... 53/451, 551, 452, 558, 554, 478, 485, 53/422, 425, 426, 167, 410, 133.1, 133.2, 53/562

See application file for complete search history.

(56) References Cited

U.S. PATENT DOCUMENTS 3,246,444 A * 4/1966 Paisley ..... B65B 9/093 222/107
3,894,381 A * 7/1975 Christine ..... B29C 66/49 53/133.2

(Continued)

FOREIGN PATENT DOCUMENTS

EP 1050468 A1 11/2000
EP 1759998 A1 3/2007

(Continued)

OTHER PUBLICATIONS

International Search Report from Application No. PCT/JP2009/057321 dated May 12, 2009.
Office Action dated Jan. 20, 2015 in CA application No. 258236.

*Primary Examiner* — Andrew M Tecco
*Assistant Examiner* — Chelsea Stinson
(74) *Attorney, Agent, or Firm* — Knobbe Martens Olson & Bear LLP

(57) ABSTRACT

Provided is an aseptic filling packaging machine that includes film feeder (1), plug feeder (2), welding devices (22, and 55), sterilizer (3), and filling packaging device (5). Film feeder (1) feeds strip film (8). Plug feeder (2) feeds plug (7) to a predetermined position of fed film (8). Primary welding mechanism (22), which serves as a welding device, temporarily welds plug (7) to the predetermined position of film (8). Sterilizer (3) immerses film 8 having plug (7), which has been fed from film feeder (1), in a sterile liquid. While forming film 8 having plug (7), which has been fed from sterilizer (3), into a bag shape, filling packaging device (5) fills the formed film packaging body having the plug with content to seal it. In filling packaging device (5), secondary welding mechanism (55) that serves as a welding device completely welds plug (7) to film (8).

12 Claims, 9 Drawing Sheets

(56) References Cited

U.S. PATENT DOCUMENTS 4,366,125 A * 12/1982 Kodera ..... A61L 2/10 422/20
4,656,813 A * 4/1987 Baldini ..... B65B 55/02 53/133.1
4,709,528 A * 12/1987 Merkus ..... B29C 65/02 53/133.2
4,779,397 A * 10/1988 Christine ..... B65B 61/186 53/133.2
6,079,185 A * 6/2000 Palaniappan et al. ..... 53/412
6,510,669 B1 * 1/2003 Bellei et al. ..... 53/167
6,655,114 B2 * 12/2003 Hiramoto et al. ..... 53/479
7,100,646 B2 * 9/2006 Py ..... A61J 1/1406 141/237
7,202,341 B2 * 4/2007 McGinnis ..... A61K 38/42 530/385
7,357,276 B2 * 4/2008 Savage ..... B65D 75/5877 222/92
7,594,372 B2 * 9/2009 Micnerski ..... B31B 19/88 53/453
7,600,360 B2 * 10/2009 Schroeder ..... B65B 61/186 53/133.2
8,337,771 B2 * 12/2012 Ferrarini ..... B65B 9/14 422/292
8,375,686 B2 * 2/2013 Caudle ..... B65B 55/103 53/133.1
8,387,348 B2 * 3/2013 Caudle ..... B65B 1/186 53/133.1
9,114,569 B2 * 8/2015 Murray ..... B29C 65/74
2003/0177739 A1 * 9/2003 Lewis, Jr. ..... B65B 9/20 53/425
2004/0123883 A1 * 7/2004 Pritchard et al. ..... 134/63

FOREIGN PATENT DOCUMENTS

JP 57-068334 A 4/1982
JP 02-233331 A 9/1990
WO WO 2008035117 A1 * 3/2008
WO 2008/087711 A1 7/2008

* cited by examiner (a)

(b)

(a)

(b)

(a)

(b)

ASEPTIC FILLING PACKAGING MACHINE AND ASEPTIC FILLING PACKAGING METHOD

CROSS-REFERENCE TO RELATED APPLICATIONS

This application is the U.S. National Phase under 35. U.S.C. §371 of International Application PCT/JP2009/057321, filed Apr. 10, 2010. The International Application was published under PCT Article 21(2) in a language other than English.

TECHNICAL FIELD

The present invention relates to a filling packaging machine that continuously manufactures film packaging bodies filled with contents such as liquids or viscous materials, and more particularly to an aseptic filling packaging machine that manufactures a film packaging body having a plug and filled with content while sterilizing a film to form a packaging body.

BACKGROUND ART

The filling packaging machine of this type includes a film feeder that feeds a continuous sheet-shaped film, a content feeder that feeds content, and a filling packaging device that fills the film packaging body with the content fed from the content feeder to seal it, while forming the film fed from the film feeder into a packaging body.

In particular, in the aseptic filling packaging machine, a film sterilizer is disposed between the film feeder and the filling packaging device. The film sterilizer generally uses a hydrogen peroxide solution as a sterile liquid. The film fed from the film feeder is immersed in the sterile liquid, and then fed to the filling packaging device after the sterile liquid on the film is dried (refer to Patent Literature 1: WO2008/087711).

Some processors that use contents in film packaging bodies as raw materials have demanded that plugs be included in the film packaging bodies.

To meet such a demand, in the conventional aseptic filling packaging machine, a sterilized plug is supplied under aseptic conditions to be fixed to the film formed by the filling packaging device included in the machine.

However, this method necessitates a plug-dedicated sterilizer separate from the machine, causing the aseptic filling packaging machine to be large.

SUMMARY OF INVENTION

It is therefore an object of the present invention to manufacture, without requiring any special device to sterilize a plug, a film packaging body having the plug and filled with content, According to an aspect of the present invention, an aseptic filling packaging machine includes a film feeder that feeds a strip film, a plug feeder that feeds a plug to a predetermined position of the fed film, a welding device that welds the plug to the predetermined position of the film, a sterilizer that immerses the film having the plug, which has been sent from the film feeder side, in a sterile liquid, and a filling packaging device that forms the film having the plug, which has been sent from the sterilizer side, into a bag shape, and fills a formed film packaging body having the plug with content to seal the film packaging body.

According to another aspect of the present invention, an aseptic filling packaging method includes a welding step of supplying and welding a plug to a predetermined position of a strip film, a sterilizing step of immersing the film having the plug, and which has been passed through the welding step, in a sterile liquid, and a filling packaging step of forming the film having the plug, and which has been passed through the sterilizing step, into a bag shape, and filling a formed film packaging body having the plug with a content to seal the film packaging body.

According to the present invention, the plug is welded to the film, and then the plug is immersed together with the film in the sterile liquid. Then, by using the film having the sterilized plug, the film packaging body having the plug and filled with the content can be manufactured. Thus, there is no need to prepare any plug-dedicated sterilizer separately from the filling packaging machine.

BRIEF DESCRIPTION OF DRAWINGS

FIG. 9A is a top view, and FIG. 9B is a front view.

EXPLANATION OF REFERENCE NUMERALS

Figure 1:
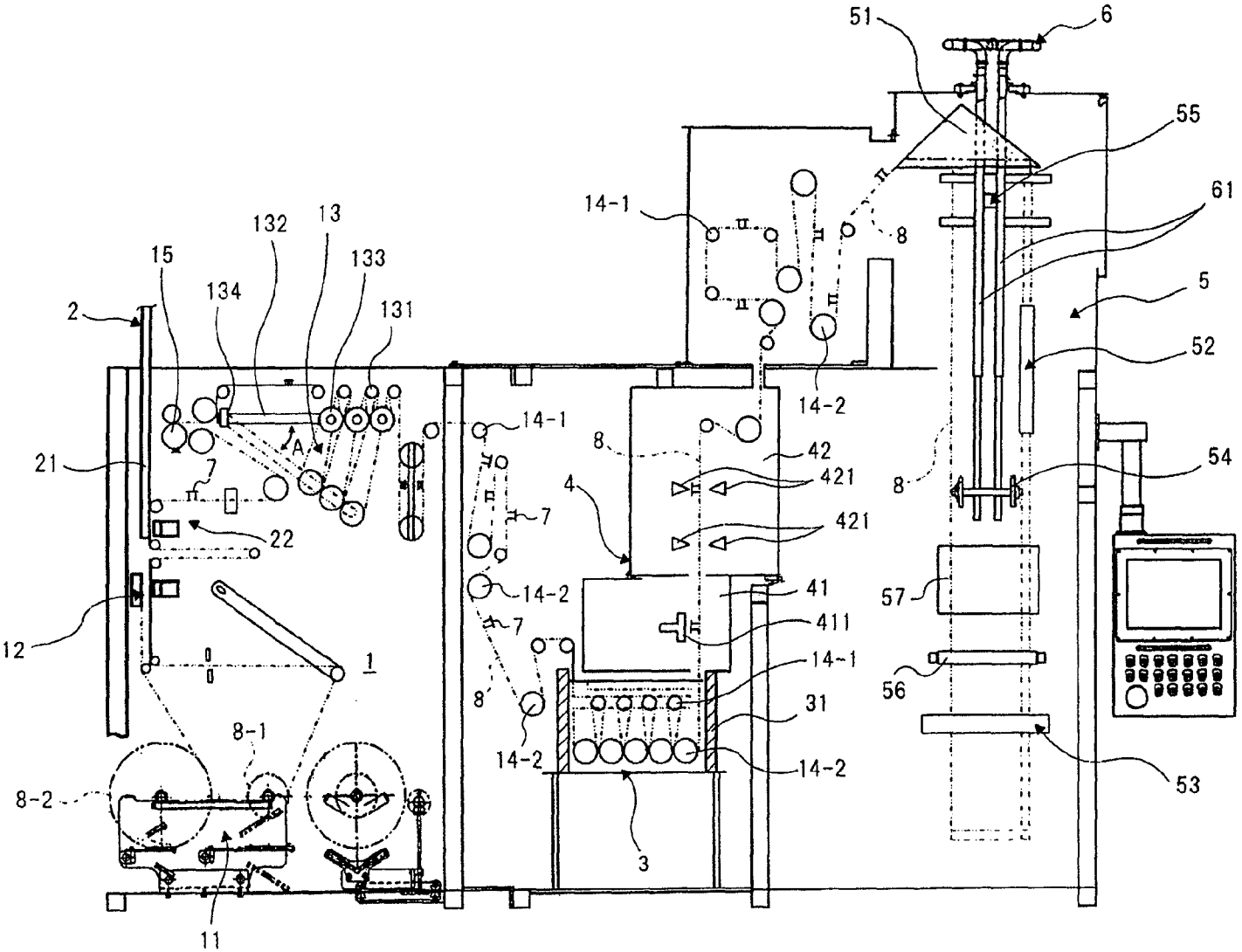
FIG. 1 is a front view showing an outline of a configuration of an aseptic filling packaging machine according to an embodiment of the present invention.

1 film feeder
11 film switching mechanism
12 film welding mechanism
13 accumulation mechanism
131 guide roller
132 lever
133 accumulation roller
134 shaft
14, 14-1, 14-2 feed roller
14 a recess
15 driving roller
2 plug feeder
21 plug shooter

22 primary welding mechanism
22*a* heater portion
23 separation mechanism
24 plug detection sensor
3 sterilizer
31 sterilization tank
4 drying device
41 plug drying room
411 blower
42 film drying room
421 blower
5 filling packaging device
51 bag-making guide
51*a* slope
51*b* cylindrical hole
51*c* edge
52 vertical sealing mechanism
521 vertical seal bar
53 horizontal sealing mechanism
531 horizontal seal bar
54 auxiliary feed roller
55 secondary welding mechanism
55*a* heater portion
55*b* pressing portion
56 drawing roller
57 forming plate
58 plug detection sensor
6 content feeder
61 input pipe
7 plug
7*a* opening
7*b* temporary welding point
8, 8-1, 8-2 film

DESCRIPTION OF EMBODIMENTS

Hereinafter, an embodiment of the present invention is described with reference to the drawings.

Figure 2:
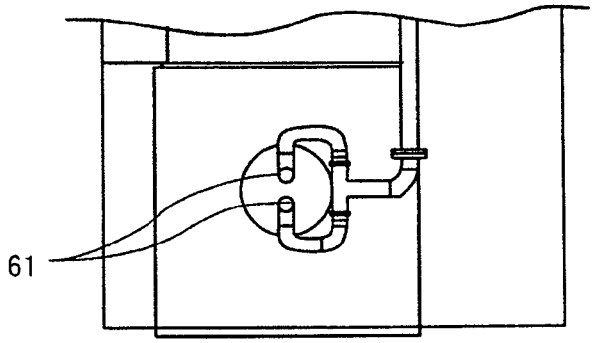
FIGS. 2A and 2B are respectively a top view and a side view showing a filling packaging device included in the aseptic filling packaging machine shown in FIG. 1.
Figure 2:
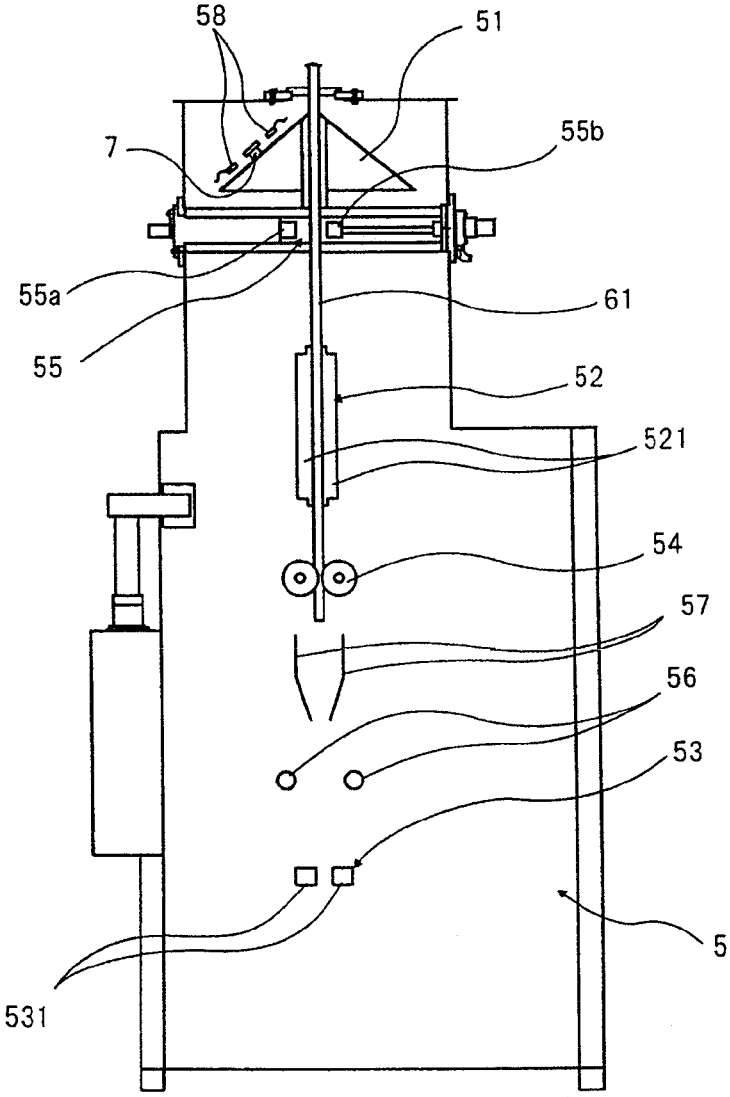

As shown in FIG. 1 and FIGS. 2A and 2B, an aseptic filling packaging machine according to the embodiment includes film feeder 1, plug feeder 2, sterilizer 3 that sterilizes a film having a plug, drying device 4 for drying sterile liquid, vertical filling packaging device 5 that seals, while forming the film into a bag shape, content filling a formed film packaging body, and content feeder 6 that feeds the content to filling packaging device 5.

Figure 3:
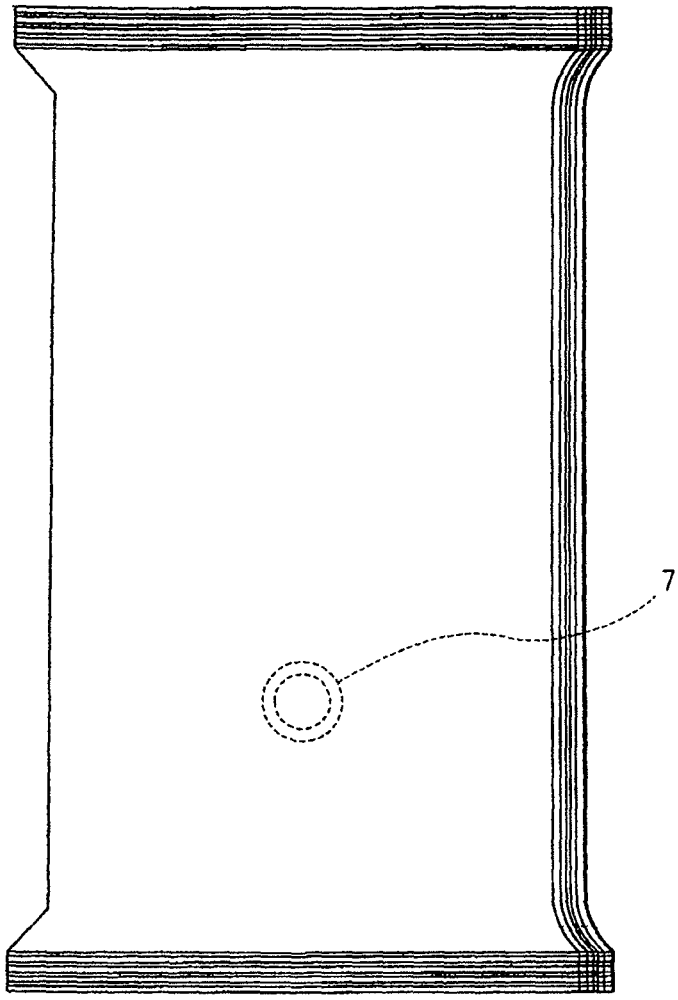
FIGS. 3A and 3B are respectively a plan view and an end view showing a film packaging body having a plug and filled with content in the aseptic filling packaging machine according to the embodiment.
Figure 3:
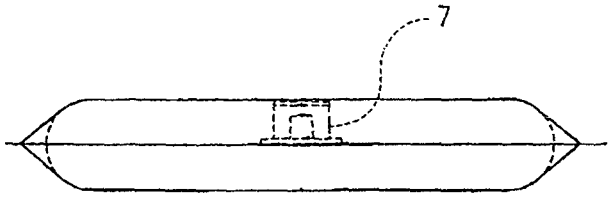
Figure 4:
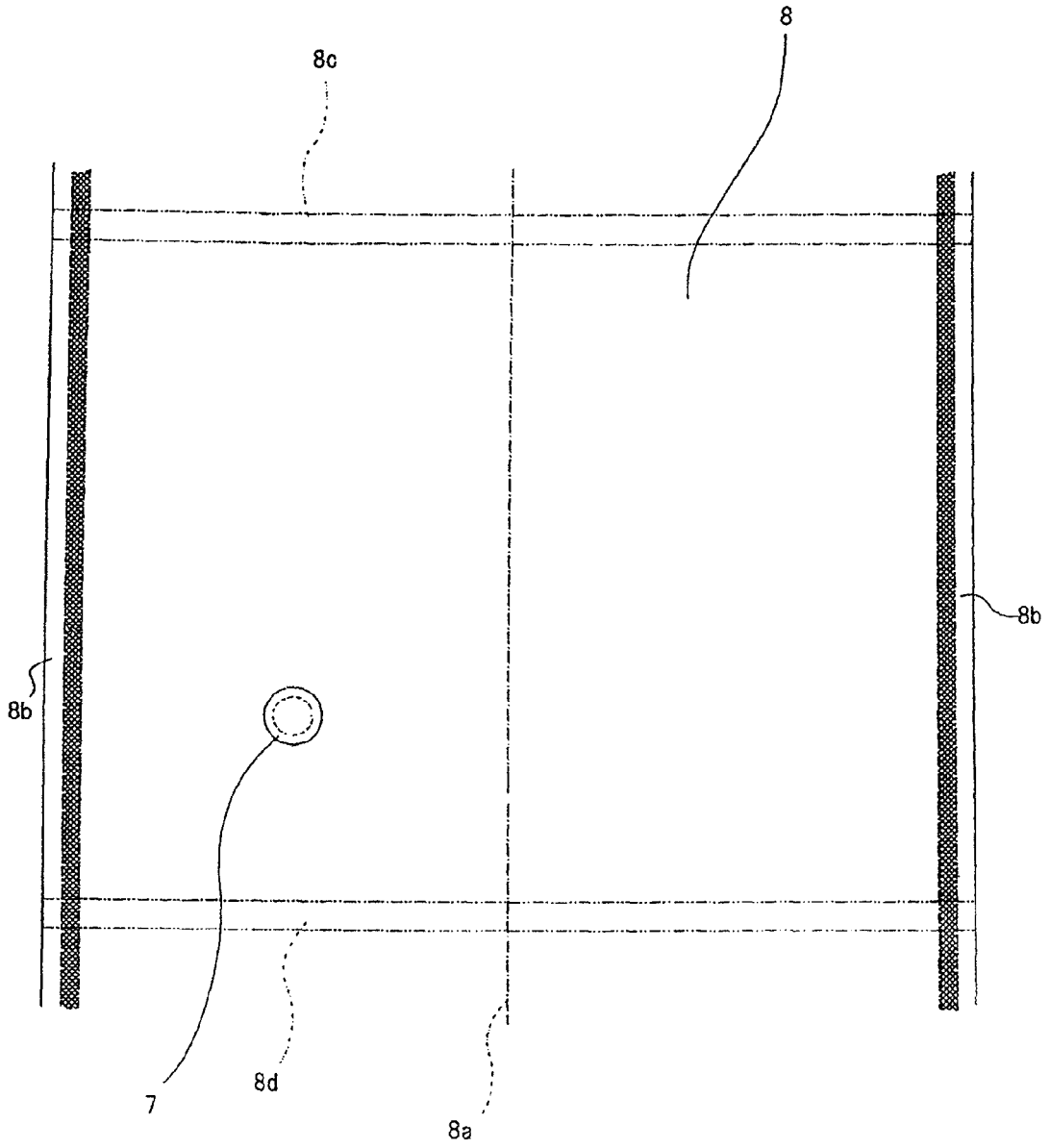
FIG. 4 shows a form of a film for forming the film packaging body having the plug shown in FIGS. 3A and 3B.

The aseptic filling packaging machine according to the embodiment manufactures a film packaging body having plug 7 and filled with content shown in FIGS. 3A and 3B while carrying out sterilization. The packaging body according to the embodiment has the shape of a three-way sealed bag. In other words, as shown in FIG. 4, strip film 8 is folded at its width center 8*a*, both edges 8*b* are thermally welded to form a cylindrical shape, and upper side 8*c* and lower side 8*d* of film 8 are thermally welded to form a bag shape. The embodiment shows a type where plug 7 is fixed to an inner surface of the bag.

Figure 5:
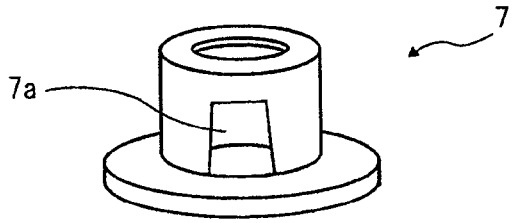
FIG. 5 is a perspective view showing a shape of the plug used in the aseptic filling packaging machine according to the embodiment.

Plug 7 is immersed in a hydrogen peroxide solution to be sterilized. Hence, plug 7 can employ any shape as long as it enables easy removal of the hydrogen peroxide solution after immersion. In the embodiment, as shown in FIG. 5, plug 7 has a cylindrical body that includes a through-hole at its center, and a plurality of openings 7*a* are formed on a side wall of the cylindrical body to communicate with the through-hole. This facilitates removal of the hydrogen peroxide solution.

Next, an operation of the aseptic filling packaging machine is described.

Film feeder 1 feeds one 8-1 of two films loaded on film switching mechanism 11 that is not under an aseptic environment. The fed film is a film that will now be used. Other film 8-2 has its leading end held by a film pressing member of film welding mechanism 12. The held film is a film in a standby state. This aseptic filling packaging machine includes accumulation mechanism 13 that switches, when the film that is being used now reaches its end, to the film in the standby mode without stopping an operation of filling packaging device 5.

Plug shooter 21 feeds plug 7 to film 8 fed from a roll film of film switching mechanism 11. Primary welding mechanism 22 temporarily welds at least one point of plug 7 to a predetermined position of a surface of film 8.

Film 8 to which plug 7 has temporarily been welded passes through a predetermined traveling path such as accumulation mechanism 13 to be fed to sterilizer 3. Film 8 having the plug, and which has been supplied to sterilizer 3, is sterilized in a hydrogen peroxide solution in sterilization tank 31. Drying device 4 then dries film 8 to feed it to filling packaging device 5.

Filling packaging device 5 folds fed film 8 in half via bag-making guide 51, and thermally welds film edges by vertical sealing mechanism 52 to form film 8 into a cylindrical shape. Sterilized content fed from content feeder 6 is input to film 8 formed into the cylindrical shape via input pipe 61.

Cylindrical film 8, to which the content has been input, is thermally welded at fixed intervals in a longitudinal direction of film 8 by horizontal sealing mechanism 53, thereby continuously manufacturing a film packaging body having the plug.

Each device included in the aseptic filling packaging machine is described in detail.

[Film Feeder 1]

As shown in FIG. 1, film feeder 1 holds film 8-1 wound in a roll, and continuously feeds film 8 to sterilizer 3 of the next stage. Film feeder 1 has, in the standby state, another film 8-2 wound in a roll. When feeding of film 8-1 that is being used now reaches its end, film 8-2 in the standby state is coupled with film 8-1 that is being used now to prevent interruption of film feeding to vertical filling packaging device 6.

Film feeder 1 includes film switching mechanism 11 for switching film 8 to be fed, film welding mechanism 12 for coupling film 8-2 in the standby state with film 8-1 that is now being used, and accumulation mechanism 13 that enables feeding of film 8 to filling packaging device 6 even while feeding of film 8 is interrupted at film switching mechanism 11 and film welding mechanism 12.

Accumulation mechanism 13 includes a plurality of guide rollers 131 arranged on the film traveling path, and a plurality of accumulation rollers 133 supported by lever 132. Film 8 is alternately hung on guide roller 131 and accumulation roller 133 to be pulled in a meandering manner. Lever 132 is supported to swing around shaft 134 in arrow direction A. Swinging lever 132 causes a change in path length of film 8. Thus, even while film feeding is interrupted during coupling of the films, film 8 stored in accumulation mechanism 13 can be fed to filling packaging device 6.

On the downstream side of accumulation mechanism 13, a plurality of feed rollers 14 is disposed to feed film 8 fed from film feeder 1 through sterilizer 3 and drying device 4 to vertical filling packaging device 5.

On the upstream side of accumulation mechanism 13, driving rollers 15 are arranged to hold film 8 therebetween and feed it to accumulation mechanism 13. Driving roller 15 is rotated by using a servo motor so that the feeding amount of film 8 can be highly accurately controlled.

[Plug Feeder 2]

Plug feeder 2 includes plug shooter 21 that guides plug 7 to a predetermined position of fed film 8, and primary welding mechanism 22 that temporarily welds one plug 7 set at a leading end of plug shooter 21 to a predetermined position of the surface of film 8. The leading end of plug shooter 21 and primary welding mechanism 22 are in opposing positions sandwiching film 8 conveyed between film welding mechanism 12 and accumulation mechanism 13.

Figure 6:
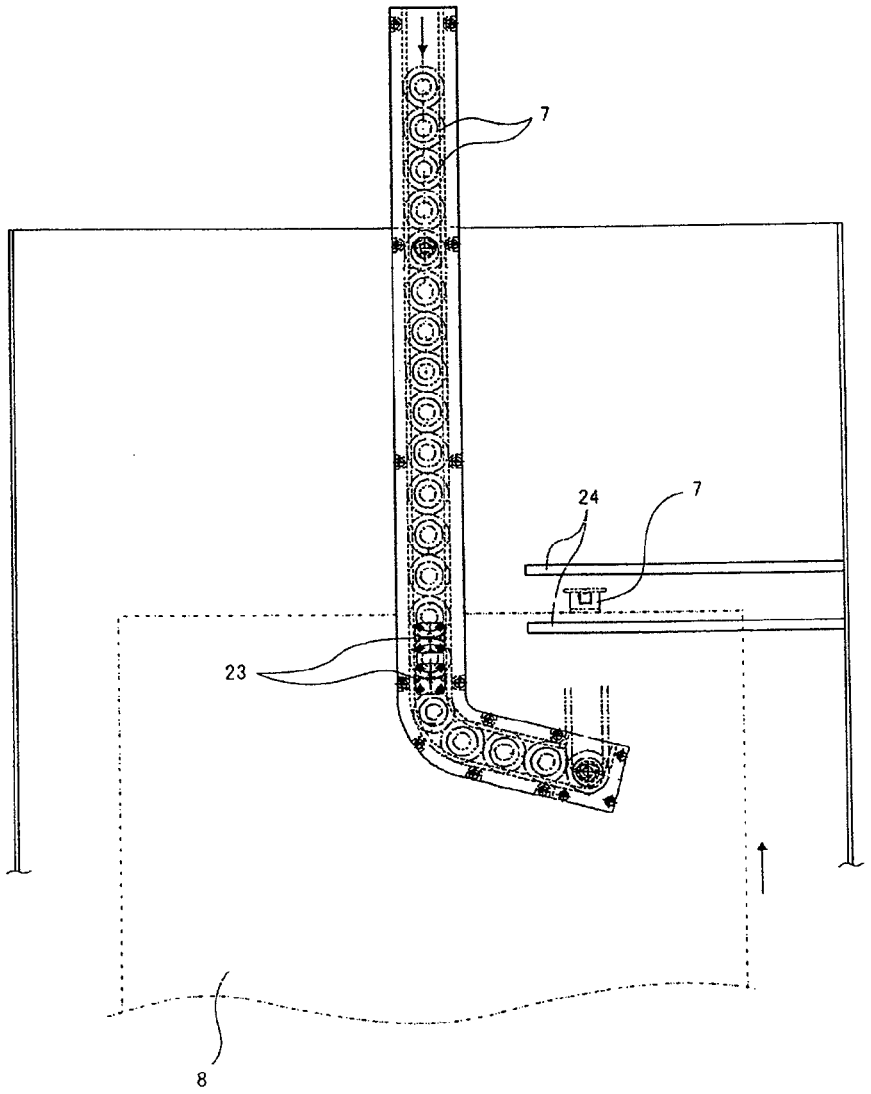
FIG. 6 shows a configuration of a plug shooter seen from a left side face of the aseptic filling packaging machine shown in FIG. 1.
Figure 7:
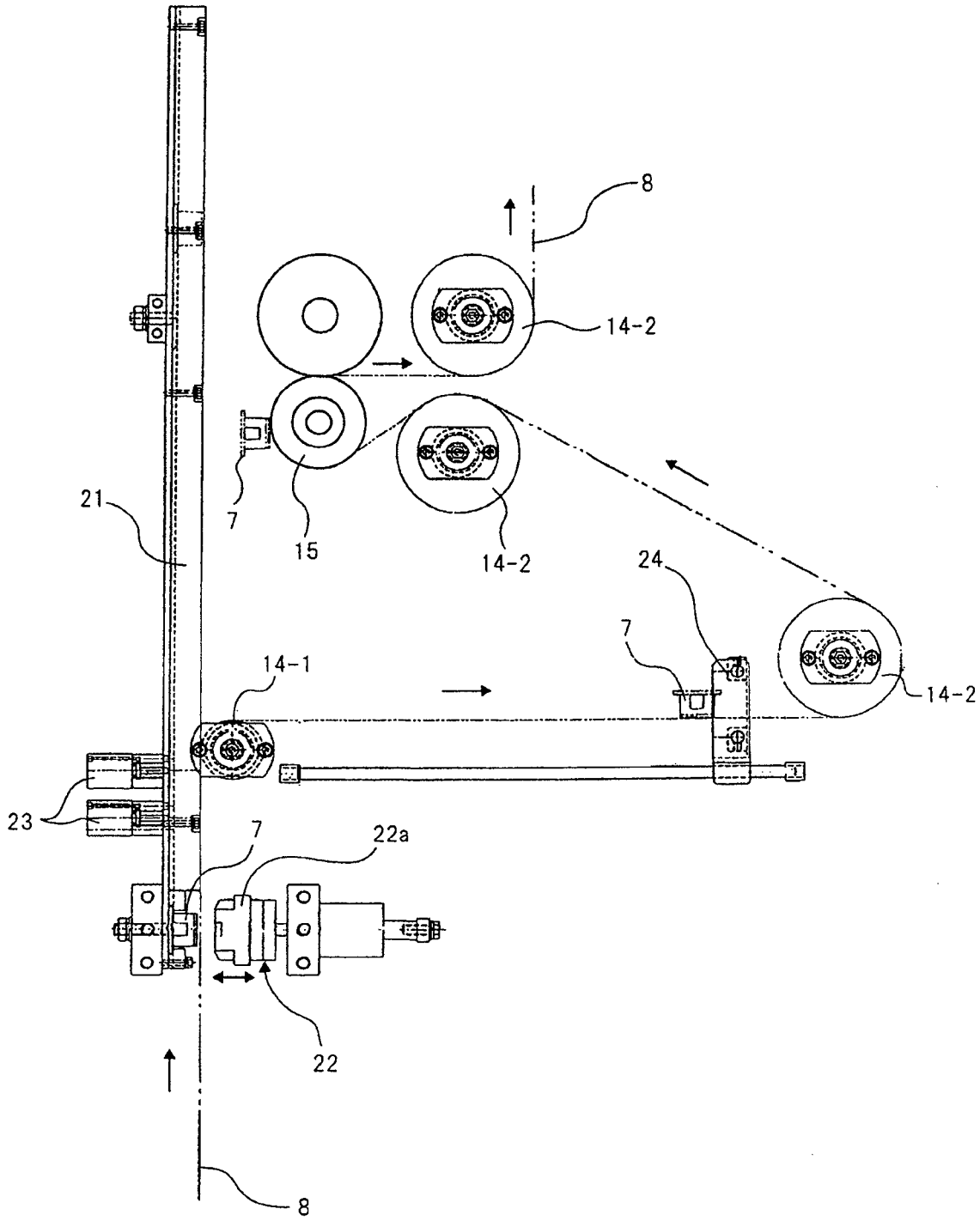
FIG. 7 is an enlarged view showing a plug shooter and a primary welding mechanism seen from a front face of the aseptic filling packaging machine shown in FIG. 1.

FIG. 6 shows a configuration of plug shooter 21 seen from the left side face of the aseptic filling packaging machine. FIG. 7 is an enlarged view showing plug shooter 21 and primary welding mechanism 22 seen from the front face of the aseptic filling packaging machine.

As shown in FIG. 6, plug shooter 21 is a member for lining up a plurality of plugs 7 while housing and holding flange portions of plugs 7 fed from the plug feeder (not shown) to guide them to the downstream side, and extends vertically downward from above the aseptic filling packaging machine. Plug shooter 21 directs, to the surface of film 8, a surface of plug 7 to be welded to the surface of the conveyed film 8.

A lower end (leading end) of plug shooter 21 is bent to be disposed in an oblique state near a horizontal state. This facilitates positioning of plug 7 to a place (refer to FIG. 4) on the surface of conveyed film 8 to which plug 7 should be fixed. It is preferred that directly above the bent portion of plug shooter 21, separation mechanism 23 be disposed to separate continuous plugs 7 one by one and drop them into the leading end of plug shooter 21.

As shown in FIG. 7, primary welding mechanism 22 is disposed to face a position of first plug 7 located at the leading end of plug shooter 21, while arranging film 8 between primary welding mechanism 22 and first plug 7. Primary welding mechanism 22 includes heater portion 22*a* movable close to or away from plug 7 at the leading end of plug shooter 21. Heater portion 22*a* is controlled to a predetermined temperature. Thus, plug 7 can be welded to the surface of film 8 by temporarily stopping conveyance of film 8 and extending heater portion 22*a* to press film 8 to plug 7.

In the welding process, a part (two points in the embodiment) of the surface of plug 7 facing film 8 is welded to film 8. As described below in detail, point welding rather than full-surface welding is employed for the purpose of facilitating passage of film 8 around an outer circumference of feed roller 14 or passage through edge 51*c* of bag-making guide 51 and preventing peeling of plug 7 from film 8. At the end, in vertical filling packaging device 5, the entire surface of plug 7 facing film 8 is completely welded to the surface of film 8.

On a moving path of film 8 between primary welding mechanism 22 and driving roller 15, plug detection sensor 24 is disposed to check welding of plug 7 to film 8.

In the aseptic filling packaging machine, a plurality of packaging bodies filled with contents, which are manufactured at the end, are all equal in bag length, and hence welding pitches of plugs 7 in a feeding direction of film 8 must be constant. According to the embodiment, controlling driving roller 15 to rotate by the servo motor enables highly accurate control of the feeding amount of film 8. As a result, welding position intervals of the plurality of plugs 7 to film 8 can be constant.

Installing plug detection sensor 24 in a planned position where plug 7 arrives when film 8 is supplied by a predetermined amount so as to stop after the temporary welding of plug 7 enables checking of whether arranging pitches of plugs 7 are constant.

Next, feed roller 14 disposed on the conveyance path of film 8 is described in detail.

According to the present invention, film 8 having plug 7 fed from the roll film is sequentially moved from film feeder 1 into sterilizer 3, drying device 4, and filling packaging device 5. Hence, feed roller 14 disposed on the path through which film 8 passes is processed into a shape to pass through plug 7.

Feed roller 14 includes a roller with which a surface of film 8 having plug 7 comes into contact and a roller with which a surface of film 8 having no plug 7 comes into contact. As shown in FIG. 1, therefore, there are at least two types of feed rollers 14, namely, first roller 14-1 and second roller 14-2. Second roller 14-2 is the feed roller with which the surface of film 8 having plug 7 comes into contact, and is processed to pass through plug 7. The roller diameter is accordingly larger than that of first roller 14-1.

Figure 8:
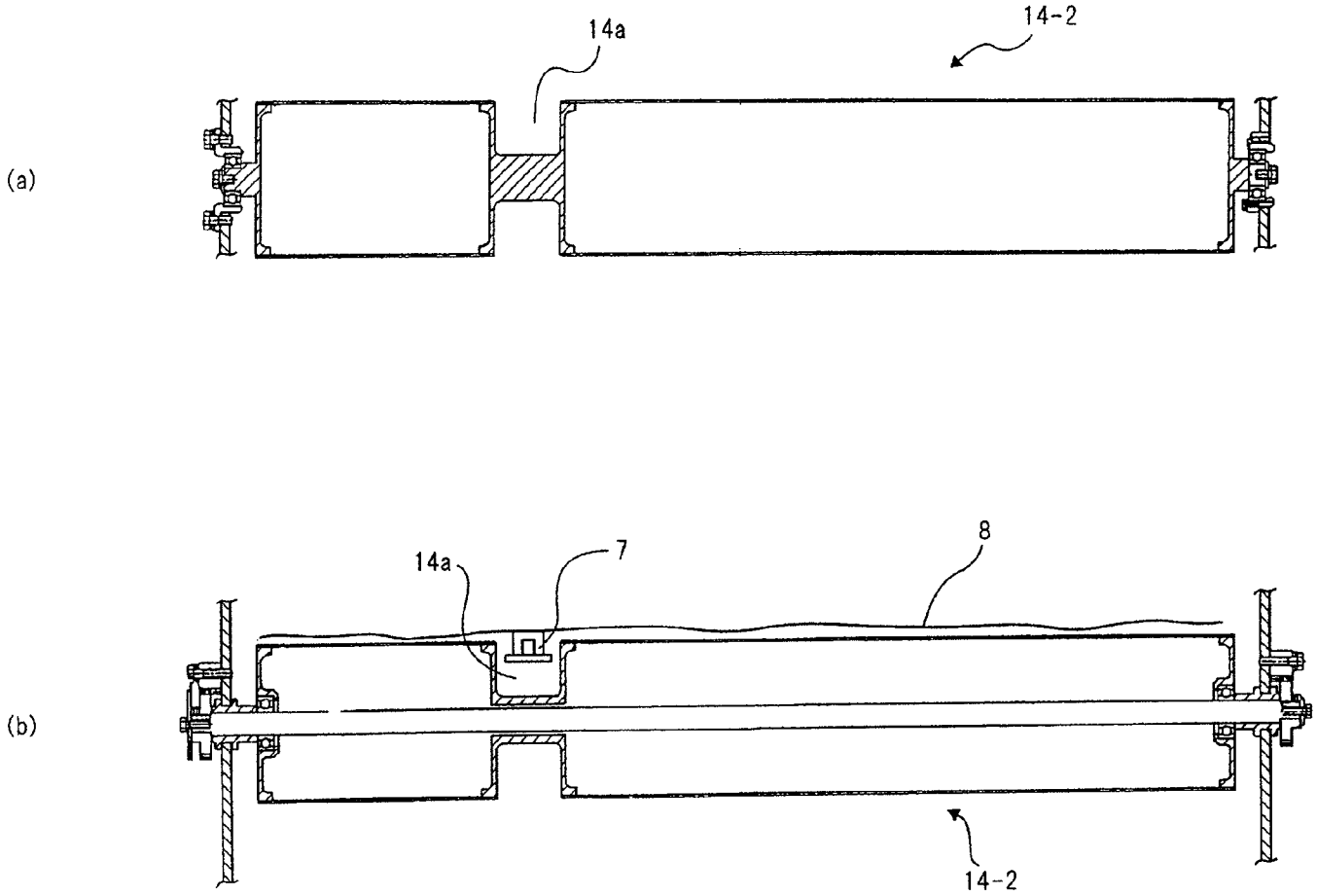
FIGS. 8A and 8B are sectional views each showing a configuration example of a feed roller with which a surface of the film side where the plug is attached comes into contact.

FIGS. 8A and 8B show sectional configuration examples of feed roller 14-2 with which the surface of film 8 having plug 7 comes into contact: FIG. 8A shows the example where a rotary shaft of feed roller 14-2 is integrally configured with a roller body, and FIG. 8B shows the example where the rotary shaft of feed roller 14-2 is configured separately from the roller body.

As shown in FIGS. 8A and 8B, the outer diameter of a portion of feed roller 14-2 through which plug 7 of film 8 passes is smaller than those of other portions. In other words, in the circumferential surface of feed roller 14-2, recess 14*a* is formed to avoid plug 7 of film 8. This enables passage of plug 7 together with film 8 around an outer circumference of feed roller 14-2.

Plug 7 is temporarily welded to film 8 at two points. Thus, when film 8 passes around an outer circumference of feed roller 14-1 while the surface of film 8 having no plug 7 comes into contact with the circumferential surface of feed roller 14-1, no excessive force is applied on moving plug 7, and plug 7 is not peeled from film 8.

[Sterilizer 3]

As shown in FIG. 1, sterilizer 3 sterilizes film 8 having plug 7, which has been fed from film feeder 1. A hydrogen peroxide solution is used as sterile liquid. The hydrogen peroxide solution fills sterilization tank 31. In sterilization tank 31, a roller unit that includes a plurality of alternately arranged feed rollers 14 is installed so as to be removed from sterilization tank 31. Film 8 is pulled in a meandering manner by alternately hanging film 8 on feed rollers 14.

As shown in FIG. 1, when the aseptic filling packaging machine is operated in the installed state of the roller unit in sterilization tank 31 filled with the hydrogen peroxide solution, film 8 having plug 7 is immersed in the hydrogen peroxide solution to be fed. As a result, plug 7 and film 8 are simultaneously sterilized.

[Drying Device 4]

Drying device 4 dries the hydrogen peroxide solution stuck to plug 7 and film 8 during passage of film 8 through sterilizer 3 by blowing hot air.

As shown in FIG. 1, drying device 4 includes plug drying room 41 for exclusively drying plug 7, and film drying room 42 for exclusively drying film 8.

Plug drying room 41 and film drying room 42 are arranged in this order along the film conveyance path from sterilizer 3 to filling packaging device 5.

In plug drying room 41, blower 411 is installed to intensively blow hot air to plug 7 temporarily welded to one surface of film 8. In film drying room 42, a plurality of sets of blowers 421 are installed to face each other sandwiching film 8. Blower 421 is formed into a long shape to blow hot air toward the entire film width of both surfaces of film 8 that travels between blower 421 and its opposite blower 421.

[Filling Packaging Device 5]

Filling packaging device 5 manufactures a film packaging body filled with content by using sterilized film 8 having the plug, which has been passed through sterilizer 3 and drying device 4, and the content is supplied from content feeder 6. Mechanisms and components for completing the film packaging body filled with the content from sterilized film 8 having the plug are arranged in a room under an aseptic environment.

For filling packaging device 5, a general vertical filling packaging device shown in FIG. 1 and FIGS. 2A and 2B, which includes at least bag-making guide 51, vertical sealing mechanism 52, and horizontal sealing mechanism 53, can be used.

Bag-making guide 51 forms film 8 passed through drying device 4 by folding it in half in a longitudinal direction so that both side edges can match each other, and guides film 8 downward. Below bag-making guide 51, auxiliary feed roller 54 is disposed to assist downward feeding of film 8.

FIGS. 9A to 9C and FIGS. 10A and 10B show a configuration of bag-making guide 51, particularly the way film 8 having plug 7 is fed along bag-making guide 51 to be formed into a cylindrical shape.

Figure 9:
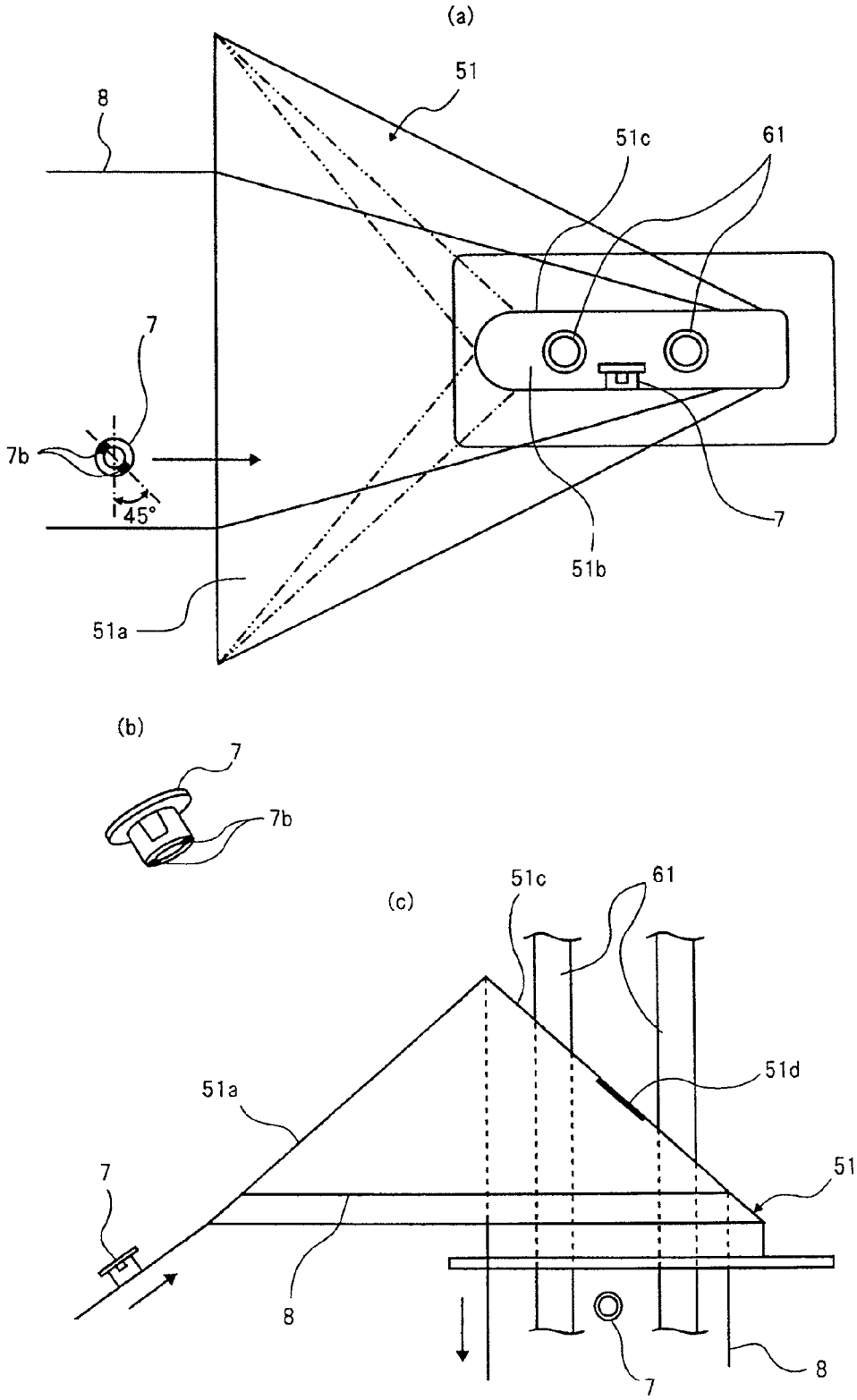
FIGS. 9A to 9C show a configuration example of a bag-making guide for forming the film into a bag shape while guiding it.

First, film 8 is fed along slope 51*a* of bag-making guide 51 from a left side shown in FIG. 9A (side where drying room 4 is located as seen from filling packaging device 5). In this case, the surface of film 8, to which plug 7 has been added, is directed oppositely to bag-making guide 51, namely, upwards (refer to FIG. 9B). Two temporary welding points 7*b* of plug 7 temporarily welded to the film surface are tilted by about 45 degrees with respect to the film longitudinal direction that is a feeding direction of film 8 (refer to FIG. 9A). Positions of these temporary welding points are defined based on welding positions at heater portion 22*a* of primary welding mechanism 22 (refer to FIG. 7).

Figure 10:
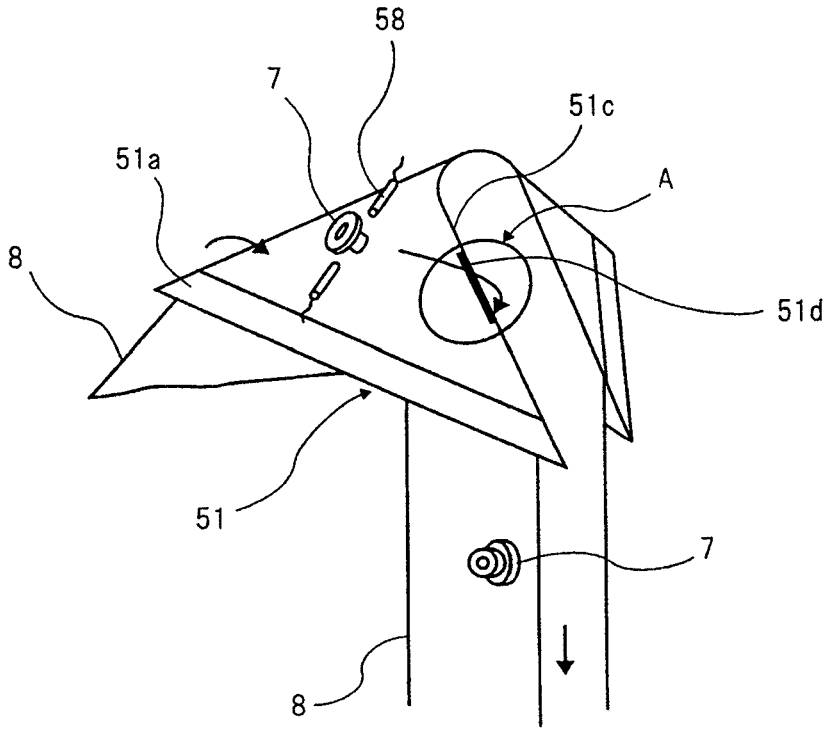
FIGS. 10A and 10B are respectively a perspective view showing the film fed along the bag-making guide and a view showing an appearance of the plug at a portion A shown in FIG. 10A.
Figure 10:
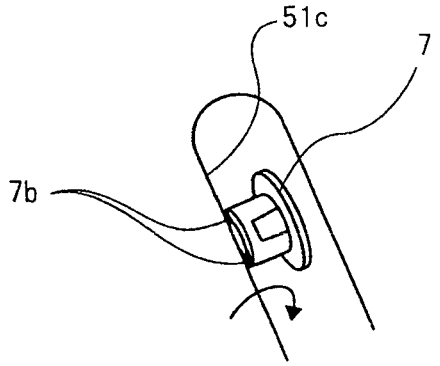

Film 8 fed along slope 51*a* of bag-making guide 51 is dropped into cylindrical hole 51*b* of bag-making guide 51, folded in half to be formed into a cylindrical shape, and fed downward (refer to FIG. 9A and FIG. 10A). In this case, film 8 is folded at edge 51*c* of cylindrical hole 51*b* of bag-making guide 51, and the surface of film 8 directed upward at slope 51*a* then faces slope 51*a*. As a result, plug 7 is located inside film 8 formed into the cylindrical shape.

A shown in FIG. 10A, when film 8 enters cylindrical hole 51*b* of bag-making guide 51, by a tensile force applied on film 8, the surface of film 8, to which no plug 7 is added, is moved while being pressed to edge 51*c* of bag-making guide 51. In this case, as shown in FIG. 10B, the positions of two temporary welding points 7*b* of plug 7 simultaneously reach edge 51*c*.

Hence, no excessive force is applied on welding points 7*b*, nor is plug 7 peeled from the surface of film 8. To acquire this effect, according to the embodiment, as shown in FIG. 9A, two welding points 7*b* of plug 7 are tilted by about 45 degrees with respect to the film longitudinal direction. However, these arranging angles are appropriately changed depending on a shape of bag-making guide 51.

According to the embodiment, recess 51*d* is formed in a plug passage portion of edge 51*c* of bag-making guide 51 (refer to FIG. 9C and FIG. 10A). This avoids contact of temporary welding points 7*b* of plug 7 with edge 51*c* during passage of the portion of film 8 to which plug 7 has been added through edge 51*c* of bag-making guide 51. Thus, peeling of plug 7 from the film surface can be surely prevented.

Plug 7 is temporarily welded to film 8 at the two points as described above. However, the number of temporary welding points 7*b* is not limited to two. Plug 7 can be temporarily welded at one point. In the case of one point, however, depending on the area of temporary wielding point 7*b*, weight of plug 7, or on the thickness or hardness of film 8, during passage of a portion of plug 7 through the outer circumference of feed roller 14 or edge 51*c* of bag-making guide 51, plug 7 may move around one welding point to be peeled from the film surface. Thus, in the case of the area of temporary welding point 7*b*, the weight of plug 7, or the thickness or hardness of film 8 in which there is no such problem, plug 7 can be welded at one temporary welding point. However, it is preferred, as in the case of the embodiment, that plug 7 be temporarily welded at two points set in a predetermined direction.

Above slope 51*a* of bag-making guide 51 and above a position through which the portion of film 8 having plug 7 added thereto passes, plug detection sensors 58 are installed to check the presence of plug 7 on film 8. Plug detection sensor 58 is, for example, a light transmissive sensor.

Generally, when a bag is made while feeding a light-transmissive transparent or half-transparent film is being fed, a registration mark is added to the film, and film feeding is controlled based on the registration mark. According to the embodiment, even when completely plain film 8 having no characters or mark is used, accurate film feeding can be enforced by using plug 7 added to film 8 in place of the registration mark and detecting plug 7 by plug detection sensor 58. The amount of film is fed to a position of secondary welding mechanism 55 is controlled based on detection of plug 7 by plug detection sensor 58.

Next, mechanisms on the downstream side of bag-making guide 51 are described.

Referring to FIG. 1 and FIGS. 2A and 2B, secondary welding mechanism 55 and vertical sealing mechanism 52 are located between bag-making guide 51 and auxiliary feed roller 54. According to the embodiment, secondary welding mechanism 55 is located between bag-making guide 51 and vertical sealing mechanism 52. However, secondary welding mechanism 55 can be located anywhere as long as it is between content discharge port of input pipe 61 and bag-making guide 51.

Secondary welding mechanism 55, which completely welds, for plug 7 temporarily welded to film 8 at the two points, the entire surface of the film side of plug 7 to film 8, includes heater portion 55*a*, and pressing portion 55*b* for pressing the portion of film 8 having plug 7 added thereto to heater portion 55*a*. Heater portion 55*a* is controlled to a predetermined temperature. This mechanism can completely weld the entire surface of plug 7 facing the surface of film 8 to film 8 by temporarily stopping feeding of film 8 and extending pressing portion 55*b* to press the portion of film 8 having plug 7 added thereto to heater portion 55*a*.

Vertical sealing mechanism 52 includes a pair of vertical seal bars 521 arranged to face each other interposing the traveling path of the edges of film 8 matched with each other by bag-making guide 51. At least one of the pair of vertical seal bars 521 includes heating means (not shown) such as an electric heater. Vertical seal bar 521 is driven to intermittently pressurize and heat the opposing edges of film 8 at fixed timing in synchronization with the feeding of film 8. Thus, the edges of film 8 folded to match each other are thermally welded together over the entire longitudinal direction of film 8 to form a cylindrical film. Content is input from input pipe 61 of content feeder 6 into the film formed into the cylindrical form.

Horizontal sealing mechanism 53 includes a pair of horizontal seal bars 531 arranged to face each other interposing film 8 below a leading end (content discharge port) of input pipe 61, and thermally welds film 8 over the entire width in its width direction (direction perpendicular to the film feeding direction). Horizontal seal portions over the entire width of film 8 are formed at constant intervals in the longitudinal direction of film 8 by intermittently driving horizontal seal bar 531 at fixed timing in synchronization with the feeding of film 8. Thus, the content input into the cylindrical film is sealed.

A film portion plotted by two horizontal seal portions vertically adjacent to each other becomes one packaging unit. Horizontal sealing mechanism 53 can further include a cutter (not shown) for cutting film 8 in the width direction at the horizontal seal portion. Cutting film 8 for each horizontal seal portion by the cutter enables acquisition of a film packaging body (film packaging body having a plug and filled with a content) separated into each packaging unit. The cutter can be included in one of the pair of horizontal seal bars, or configured as a unit separate from horizontal seal bar 531.

It is preferred that filling packaging device 5 include a pair of drawing rollers 56 and a pair of forming plates 57 in addition to the above-mentioned components.

The pair of drawing rollers 56 are arranged below input pipe 61 to face each other interposing the conveyance path of film 8. Drawing rollers 56 can rotate in a direction to enable feeding of film 8 downward and move oppositely to each other to open or close. Drawing rollers 56 are formed with lengths to be able to pressurize film 8 over its entire width when closed.

By closing drawing rollers 56 in a state where the content is input to a position higher than drawing rollers 56, film 8 is crushed by welding forces of drawing rollers 56 to vertically separate the content. When drawing rollers 56 are rotated in closed states, the content above drawing rollers 56 stays above drawing rollers 56, and only the content below drawing rollers 56 is fed together with film 8 while cylindrical film 8 is crushed by drawing rollers 56. The portion of film 8 crushed by drawing rollers 56 is thermally welded by horizontal sealing mechanism 53, thereby manufacturing a film packaging body that does not contain any air.

The pair of forming plates 57 are arranged, between drawing rollers 56 and horizontal sealing mechanism 53, interposing film 8 to oppositely move in a direction for approaching to or being separated from each other. Forming plates 57 hold the portion of film 8 filled with the content therebetween at a predetermined interval to suppress swelling of film 8, thereby reshaping the portion of film 8 to which the content has been input. This suppresses variability on content capacity. The bending of both side edges of film 8 that is formed into a cylindrical shape caused by the weight of content filling film 8 is reduced. Hence, while cylindrical film 8 is crushed by drawing rollers 56 to be thermally welded by horizontal sealing mechanism 53, wrinkles are difficult to be generated on film 8.

When there is no need to suppress the swelling of film 8, for example, when the content is light or when there is no strict requirement for content capacity, there is no need to always install forming plates 57.

[Content Feeder 6]

Content feeder 6 appropriately adjusts the content to fill the film packaging body, when necessary, in order to feed it to filling packaging device 5.

Content feeder 6 includes input pipe 61 to input the content into the film packaging body formed by filling packaging device 5.

According to the embodiment, when filling packaging device 5 folds film 8 to form the film packaging body shown in FIGS. 3A and 3B, plug 7 is located at the center of the inner surface of the film packaging body. To input the content into the film packaging body having the plug, it is preferred that input pipe 61 be installed so as not to interfere with plug 7 moved downward together with film 8 from the upper side in vertical filling packaging device 5.

Input pipe 61 is accordingly installed to avoid the moving path of plug 7. In the example shown in FIG. 1, two input pipes 61 are installed to sandwich the moving path of plug 7. However, the number of input pipes 61 can be one, or can be at least two, provided that they are located such that they do not block movement of plug 7 that accompanies the feeding of film 8.

The aseptic filling packaging method and the machine for implementing the method have been described, and, in particular, the filling packaging process has been described by using the example of the vertical filling packaging device. However, this example is in no way limitative of the present invention. The shape of the packaging body to be manufactured is not accordingly limited to the three-way sealed bag. The present invention can be applied even when a four-way sealed bag having four seal portions on the vertical and horizontal sides, or a standing bag to be kept standing is manufactured.

In other words, any changes can be made to the configuration and the shape of the embodiment within the scope of technological knowledge in which the plug is welded to the film, and the film and the plug are simultaneously sterilized to form the film packaging body having the plug.

The present invention can be applied to manufacturing of not only the type of package body where the plug is fixed to the inner surface of the packaging body but also to a type where a plug is fixed to an outer surface of a packing body.

The invention claimed is:

1. An aseptic filling packaging machine comprising:

a film feeder that feeds a strip film;

a plug feeder that feeds a plug to a predetermined position of the fed film;

a welding device that welds the plug to the predetermined position of the film;

a sterilizer that immerses the film having the plug, and which has been sent from the film feeder side, in a sterile liquid; and a filling packaging device that forms the film having the plug, and which has been sent from the sterilizer side, into a bag shape, and fills a formed film packaging body having the plug with content to seal the film packaging body, wherein the welding device comprises a primary welding mechanism for tack-welding the plug at a surface facing the film to a surface of the film prior to forming into the bag shape; and a secondary welding mechanism for welding the entire surface of the plug facing the film to the surface of the film, wherein the primary welding mechanism is located upstream of the sterilizer in a feeding direction of the film and oppositely to the plug fed from the plug feeder interposing the film; and the secondary welding mechanism is located downstream of the sterilizer in the feeding direction of the film and between a film forming unit of the filling packaging device and a content filling port.

2. The aseptic filling packaging machine according to claim 1, further comprising a plurality of feed rollers on which the film is wound to be moved, wherein in a circumferential surface of each feed roller with which a surface of the film having the plug comes into contact, a recess is formed to pass through the plug welded to the film.

3. The aseptic filling packaging machine according to claim 1, wherein:

the filling packaging device includes a bag-making guide through which the film passes so that the film can be folded in half to be formed into a cylindrical shape; and a recess is formed in a portion of the bag-making guide through which the portion of the film having the plug passes.

4. The aseptic filling packaging machine according to claim 1, wherein the primary welding mechanism tack-welds the plug at the surface facing the film to the surface of the film at two points.

5. The aseptic filling packaging machine according to claim 3, wherein the two tack-welded points are located in a direction along an edge of a cylindrical hole of the bag-making guide.

6. The aseptic filling packaging machine according to claim 4, wherein the two tack-welded points are located in a direction tilted at a predetermined angle with respect to a film longitudinal direction that is a feeding direction of the film.

7. The aseptic filling packaging machine according to claim 1, wherein the filling packaging device includes a plug detection sensor that detects the plug tack-welded to the film, and a length of the film that is fed into the filling packaging device is controlled based on detection of the plug by the plug detection sensor.

8. The aseptic filling packaging machine according to claim 1, further comprising, on a path of the film between the sterilizer and the filling packaging device, a drying device that dries the sterile liquid stuck to the plug and the film by blowing air to the film having the plug.

9. An aseptic filling packaging method comprising:

supplying a plug to a predetermined position of a strip film;

tack-welding the plug at a surface that comes into contact the strip film to the predetermined position of the strip film prior to forming into a bag shape;

immersing the strip film to which the plug is tack-welded in a sterile liquid;

welding the entire surface of the plug that comes into contact with the strip film after the immersing the strip film;

forming the strip film to which the plug is welded into the bag shape, and filling a formed film packaging body having the plug with content to seal the film packaging body.

10. The aseptic filling packaging method according to claim 9, wherein the film is wound on a plurality of feed rollers to be conveyed.

11. The aseptic filling packaging method according to claim 9 further comprising:

detecting the plug tack-welded to the film, and controlling a feeding length of the film based on detection of the plug.

12. The aseptic filling packaging method according to claim 9, further comprising, between the immersing the strip film and the forming the strip film, drying the sterile liquid stuck to the plug and the film by blowing air to the film having the plug.

* * * * *